US005232027A

United States Patent [19]

Tanaka et al.

[11] Patent Number: 5,232,027

[45] Date of Patent: Aug. 3, 1993

[54] APPARATUS FOR SERVING SOFT ICE CREAM OR THE LIKE

[75] Inventors: Toshinori Tanaka, Kawanishi; Osamu Arai, Tokyo; Taizo Karasawa, Ibaraki, all of Japan

[73] Assignees: Nissei Co., Ltd.; Nissei Maryland Cup Co., Ltd., both of Osaka, Japan

[21] Appl. No.: 770,618

[22] Filed: Oct. 3, 1991

[51] Int. Cl.[5] ..... B65D 85/78

[52] U.S. Cl. ..... 141/270; 141/81; 141/114; 141/276; 141/269; 141/284; 141/252; 426/516; 222/95; 222/103; 222/105

[58] Field of Search ..... 141/71, 81, 105, 114, 141/251-258, 260, 262, 263, 269, 270, 275, 276, 284; 222/95, 103, 105; 100/125, 291, 292; 426/516, 517

[56] References Cited

U.S. PATENT DOCUMENTS

| | | | |
|---|---|---|---|
| 1,663,677 | 3/1928 | Byerly | 222/95 X |
| 2,103,817 | 12/1937 | Johnson | 141/270 X |
| 2,346,561 | 4/1944 | Deway | 100/125 X |
| 3,267,971 | 8/1966 | Mueller | 141/270 X |
| 3,456,847 | 7/1969 | Scott | 222/95 |
| 3,911,972 | 10/1975 | Hubers et al. | 141/275 X |
| 4,808,346 | 2/1989 | Strenger | 222/95 X |
| 4,942,910 | 7/1990 | Hamamura | 141/270 X |
| 4,966,205 | 10/1990 | Tanaka | 141/270 X |
| 5,069,364 | 12/1991 | McGill | 222/95 |
| 5,095,955 | 3/1992 | Barnewitz et al. | 141/270 X |

FOREIGN PATENT DOCUMENTS

| | | | |
|---|---|---|---|
| 2230057 | 10/1990 | United Kingdom | 222/103 |

*Primary Examiner*—Henry J. Recla
*Assistant Examiner*—Casey Jacyna
*Attorney, Agent, or Firm*—Harness, Dickey & Pierce

[57] ABSTRACT

An apparatus for dispensing a chilled confection food or the like from a small extrudable package into a food serving container. The apparatus includes a horizontal table for supporting the extrudable package, a pusher, and a food container support table. The horizontal table and the pusher are so constructed that they press the extrudable package with their relative approaching movements along a vertical direction and extrude the chilled confection food from the extrudable package into the food container which is set on the food serving container support table.

4 Claims, 3 Drawing Sheets

1
2
3
4
4a
5
5'
6
6a
7
8
9
9a
10
10a
11
12
13
14
15
16
17
100
101
101a
102
103
104
X
Y
C
d

APPARATUS FOR SERVING SOFT ICE CREAM OR THE LIKE

BACKGROUND OF THE INVENTION

1. Technical Field

The present invention relates to an apparatus for serving a cold confection into a dish or cone from a small extrudable package filled with the cold confection. The cold confection in the small extrudable package is kept in a state of paste or softening. The cold confection includes items such as soft ice cream (also called soft-serve ice cream), whipped cream, mousse, Bavarian cream, frozen yogurt and the like. These cold confections are referred to as soft ice cream foods.

2. Discussion

Recently, demand for soft ice cream foods, such as cold confections, has been increasing due to the trend toward foods which have a soft touch to the mouth. Conventionally, these foods have been supplied by extruding same with an amount to a food container such as a cone from a big freezer adapted for a soft ice cream or from a bulky vessel and by filling same in the cone. However, such freezers or extruders having a freezer were inconvenient and therefore they could not readily adapt to various varieties of cold confections. Further, it was difficult to change the contents of the freezer as desired. Accordingly, it was necessary to increase the number of such machines and offered to meet consumers' demands. In addition, such machines included relatively complex mechanisms and therefore required a long time in disassembling, maintaining and cleaning.

An object of the present invention is to solve these and other problems in using conventional freezers adapted for soft ice creams; as well as such problems in using extruders each having a freezer. Another object is to provide a handy simplified apparatus for extruding soft ice cream food which can be kept in a sanitary condition with a minimum of effort.

It is a further object of the present invention to provide a soft ice cream food dispenser which is small enough to permit a retail outlet to serve a wide variety of soft ice cream food flavors.

SUMMARY OF THE INVENTION

To solve the above-mentioned problems, an apparatus is provided in accordance with the present invention for extruding soft ice cream food filled in a small extrudable package into a food container. The apparatus includes a horizontal table having an opening for supporting the extrudable package, a pusher positioned above the horizontal table, and a food container support table positioned beneath the horizontal table. The horizontal table and the pusher are so constructed that they press the extrudable package with their relative approaching movements along a vertical direction and extrude the soft ice cream food from the extrudable package into the food container which is set on the food container support table.

BRIEF DESCRIPTION OF THE DRAWINGS

The various advantages of the present invention will become apparent to one skilled in the art by reading the following specification and by reference to the following drawings.

An embodiment of the present invention will be described below. It will be appreciated that the embodiment does not limit the scope of the invention, but is prepared merely for its description.

DESCRIPTION OF THE PREFERRED EMBODIMENT

The apparatus for a soft ice cream food according to the present invention comprises a horizontal table for supporting an extrudable package. A pusher or pressing member is positioned above the horizontal table. A food container support table is positioned beneath the horizontal table. A drive mechanism is provided for causing the pusher and the horizontal table to approach each other relatively. A stand is provided for supporting each of the above mentioned elements. With regard to the extruding mechanism, several techniques may be used: (a) one approach is to provide a means for carrying the pusher vertically against the horizontal table which is fixed; (b) alternatively, the horizontal table may be lifted vertically against the pusher which is fixed; or (c) the pusher and the horizontal table may both move along a vertical direction to approach each other. Considering the synchronizing up and down movements of a food container support table which is referred to hereinafter, it is preferable to use the manner (a) in viewpoint of simpleness of its construction.

Figure 4:
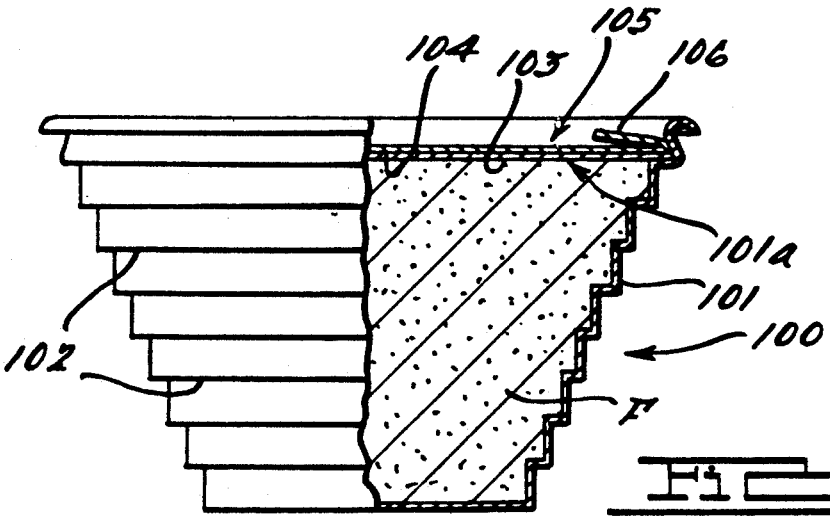
FIG. 4 is a side view of a small extrudable package, partially broken away, which is formed to adapt to the apparatus of the present invention.

The horizonal table has a size which is sufficient tc support the extrudable package, shown in FIG. 4, and at the same time it is necessary to provide the horizontal table with an extruding opening corresponding to the discharging opening of the extrudable package.

Various kinds of driving mechanisms may be utilized for causing the pusher and the horizontal table to approach each other. Fluid pressures such as an air pressure, a hydraulic pressure and the like, a mechanical reciprocation or a spring, may be used. Practically, it is preferable to convert rotational movements of a motor to reciprocal movements by means of a reduction mechanism and a grooved cam or a crank or by means of a pinion and a rack or a lineared motor. In particular, the two above mentioned mechanisms, which are listed initially, may vary strokes or speeds of linear movements of the pusher as desired and can also bring about the advantage of carrying out a filling of the soft ice cream food with decorative variations as discussed in more detail below. Further, it may use non-uniform motion mechanisms, which are well known, such as elliptic gears and the like for giving non-uniform motions.

It is of course possible to use a movable arm as a propelling force for extrusion instead of the motor. In this case, however, it is preferable to use such a manner that for example an L-shaped member is formed with a rack at a vertical portion thereof and on the other hand a pinion is mounted rotatably on a vertical portion of a fixed stand to engage with the rack and that a lever is fixed to a gear engaging with the pinion so as to transmit a descending movement of the lever by hand operations as the descending movement of the L-shaped member. Where the lever is made long, it may squeeze and crush the extrudable package requiring only a small force on the lever. Further, it is convenient to use a spring against the descending action of the lever for returning the pusher to its initial position.

In a preferable aspect of the invention, the food container support table is also constructed to move away from the horizontal table as the food extrusion progresses. As the driving mechanism for the separating action, the same mechanism as one for driving the pusher and/or the horizontal table may be used. As a preferable aspect of the invention, at the beginning of the extrusion, the extrudable package is set on the fixed horizontal table, and the pusher is set to an uppermost position away from the horizontal table and the food container support table takes a nearest position close to the horizontal table. Conversely, at the end of the extrusion, the pusher and food container support table are set to positions opposite to the positions in the state of initiation. It is preferable to construct these elements to return to their positions of preparation automatically when a cycle of extrusion is finished. It is preferable to use a grooved cam or crank in view of its ability to provide such an automatic return mechanism as described below.

Eccentric Filling Mechanism

It is preferable to construct the food container support table to rotate eccentrically with respect to the extruding axis of the extrudable package. The eccentric rotation may create decorative shapes during filling of an extruding food such as a soft ice cream into a food container, for example, a cone.

Small Extrudable Package

The present invention is not limited to a small extrudable package in shape, construction or material. But, it may preferably use a package or container which comprises a plastic cone shape which is thin and relatively hard and made of polypropylene, polystyrene, polyvinyl chloride, ethylene, polyvinyl acetate or polyethylene of high density. As shown in FIG. 4, the package comprises a main body 101 formed with a number of steps 102, a main body which has an opening 101*a* closed by a lid 103 having a discharge opening 104 and an auxiliary lid 105 having a pull 106.

When the extrudable package 100 is pressed between the horizontal table and the pusher, the soft ice cream food F is extruded through the discharge opening 104 as the main body 101 becomes flat and the soft ice cream food F is then filled into the food container, such as a cone which is set on the food container supporting table.

Practically, the soft ice cream food, which is manufactured with mass production in another line, is filled into the small extrudable package and stored in a frozen state. The extrudable package is then taken out from its storage or stocker when it is necessary, so that it may be squeezed by means of the apparatus of this invention. As a result, any kind of soft ice cream foods may be supplied very efficiently and hygienically.

According to the present invention, a handy apparatus may be provided for precisely extruding the soft ice cream food of the extrudable package into a food container. In the preferred embodiment the extrudable package only contains an amount to fill the food container on the food container supporting table. Therefore, by stocking a freezer with extrudable containers having a variety of soft ice cream foods, any of the kinds of the soft ice cream foods may be supplied quickly and hygienically. Particularly, where the grooved cam or a crank mechanism is utilized as a pusher driving mechanism, the extruding speed and stroke may be varied. Further, a movable table, which is rotated eccentrically with respect to an extruding axis, may be used as the food container support means, which together with the pusher driving mechanism, will yield a beautifully and decoratively filled soft ice cream in a cone or the like.

In more detail, referring to FIGS. 1–4, a main body 1 comprises a stand 2; a motor mount 3 vertically extending upward from un end of the strand 2; a geared motor 4 mounted on the motor mount 3; a pair of guide plates 5 and 5' standing on a middle portion of the stand 2; a horizontal table 6 for supporting an extrudable package or container and extending horizontally from an upper portion of the guide plates; an L-shaped pusher 7 freely fitting between the guiding plates, two grooved cams 9 and 10 fixed to an output shaft 4*a* of the motor 4; and roller pins 11 and 12 which freely fit in grooves 9*a* and 10*a* of the cams, each end of the roller pins being fixed to the food container support table 8 and the pusher 7, respectively.

The horizontal table 6 provides, at a middle portion thereof, an opening 6*a* for an extruded food to pass through. The food container support table 8 provides a container support table 13 rotatably mounted for supporting a container in the shape of a cone. The container support table 13 is drilled to have a conical hole 14 for supporting the cone and arranged to be rotated by means of a motor 15 via a gear 16. As shown in the drawings, an extruding center axis X—X of a package main body 101 is eccentrically shifted with an amount D with respect to an axis Y—Y of a cone C.

A push button switch 17 is attached to a side portion of the stand 2 and the motors 4 and 15 are driven by pushing the switch.

Operation

1) A tip of the cone C is inserted in the conical hole 14 of the container support table 13.

2) An extrudable package 100 is set on the horizontal table 6 to face a discharge opening 104 lined up with the opening 6*a* of the horizontal table 6.

3) When pushing the push button switch 17, the motor 15 for the container support table 13 starts to rotate and drives the container support table 13 via the gear 16.

Figure 1:
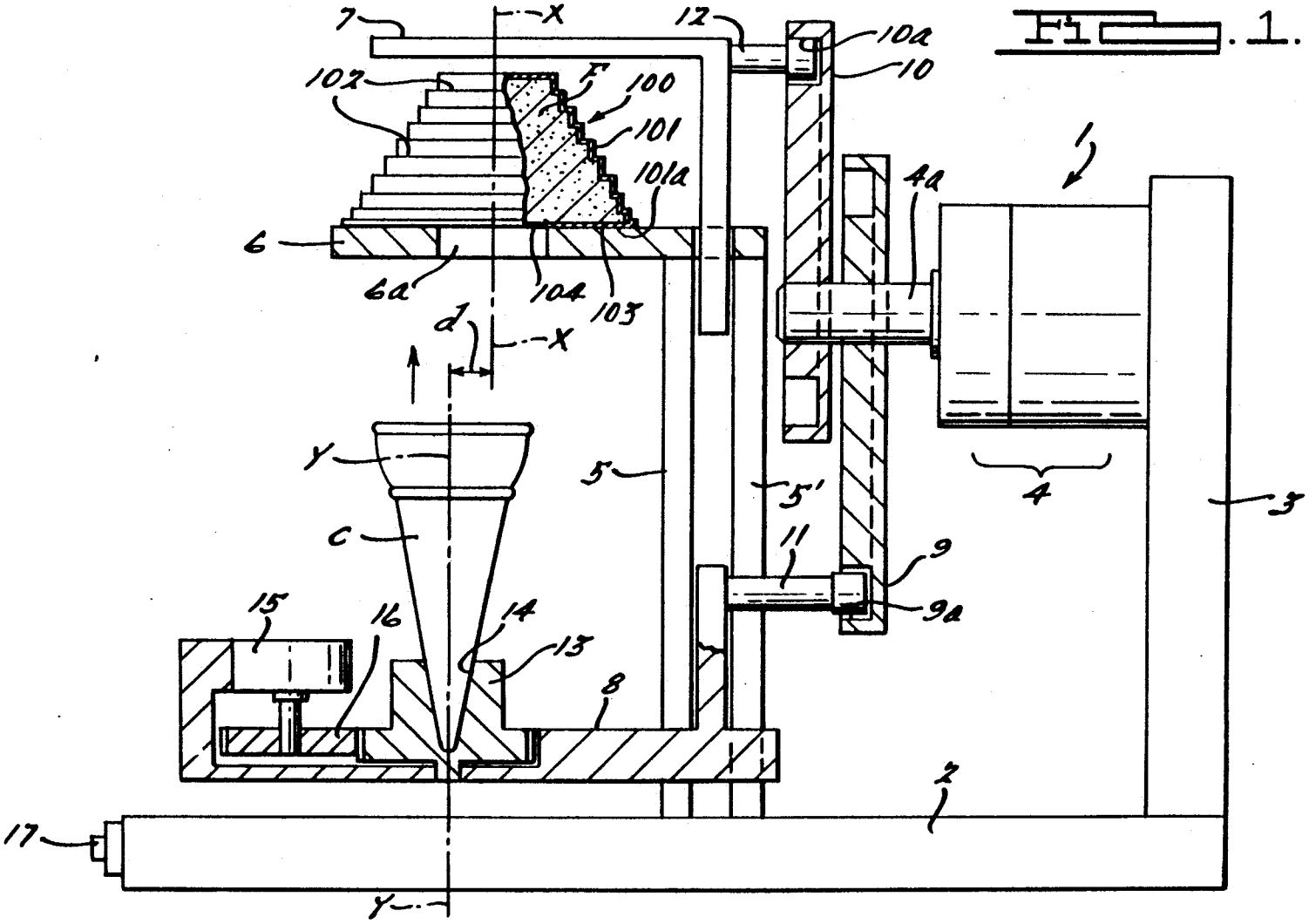
FIG. 1 is a side view of the apparatus of the present invention partially broken away.
Figure 2:
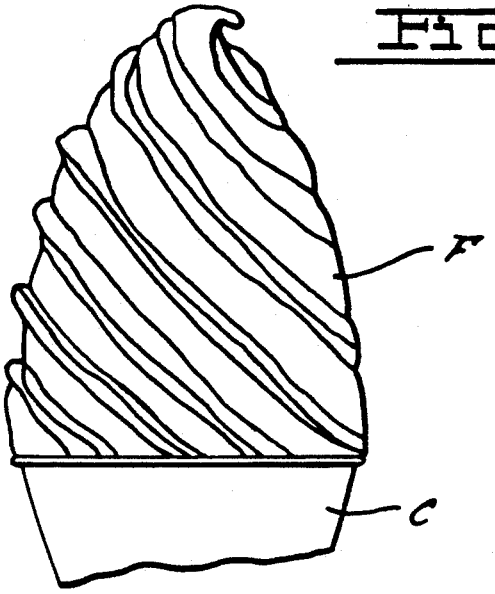
FIG. 2 is a plan view showing an example of a cam groove of the apparatus of FIG. 1.
Figure 3:
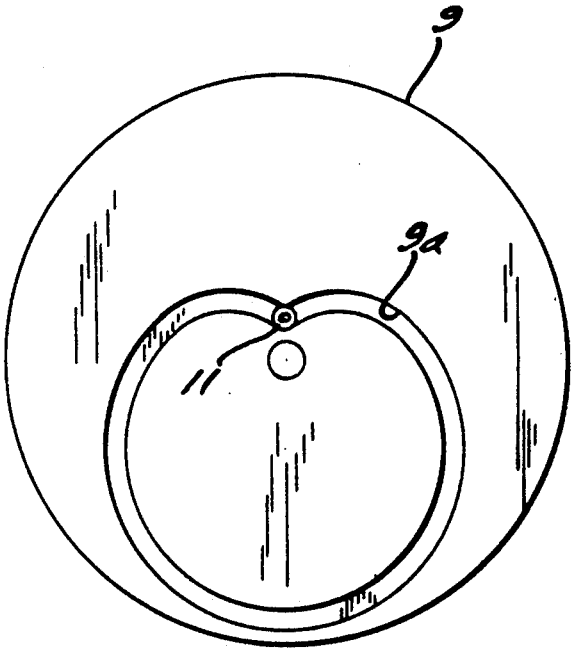
FIG. 3 is a side view showing a filling state of soft ice cream filled by utilizing the cam groove of FIG. 2.

4) With the operation of step 3 above, the motor 4 starts to rotate and drives the two grooved cams 9 and 10 which are fixed to the output shaft 4*a*. Then, the inside cam 9 for a filling operation lifts up the food container support table 8 with a predetermined amount of stroke in a direction indicated by an arrow in the drawings, by means of the roller pin 11 which is fit in the groove 9*a*. For reference, it is noted that where the groove 9*a* of the cam is formed in the shape as shown in FIG. 3, a filling state or figure of soft ice cream may be obtained as shown in FIG. 2. However, such a filling state may be varied desirably by changing a shape of the groove 9*a*.

5) When the food container support table 8 reaches an uppermost position, the pusher 7 presses the package 100 to deform same by means of the roller pin 12 which is fit in the groove 10*a* of the outside cam 10 which is fixed to the same shaft as the cam 9 for the filling operation. With the pressing operation, a filled food F is squeezed and discharged downward into the cone C via the discharge opening 104 through the opening 6*a*. At the time, a descending speed of the pusher 7 may be regulated desirably with a choice of the cam 10. On the other hand, the container support table 13 rotates eccentrically with respect to the extruding center axis X—X while the food container support table 8 descends gradually. Therefore, a variety of beautiful filling designs such as a spiral, a dumpling and others may be obtained automatically by changing the shape of the cam 9 or regulating an amount of the above-mentioned eccentric shift.

6) The motor 4 continues to rotate after finishing the filling of step 5 above and when the pusher 7 and the food container support table 8 return to the positions as shown in the drawings, the motor stops automatically. Accordingly, the crushed extrudable package or container after filling may be removed easily.

Figure 5:
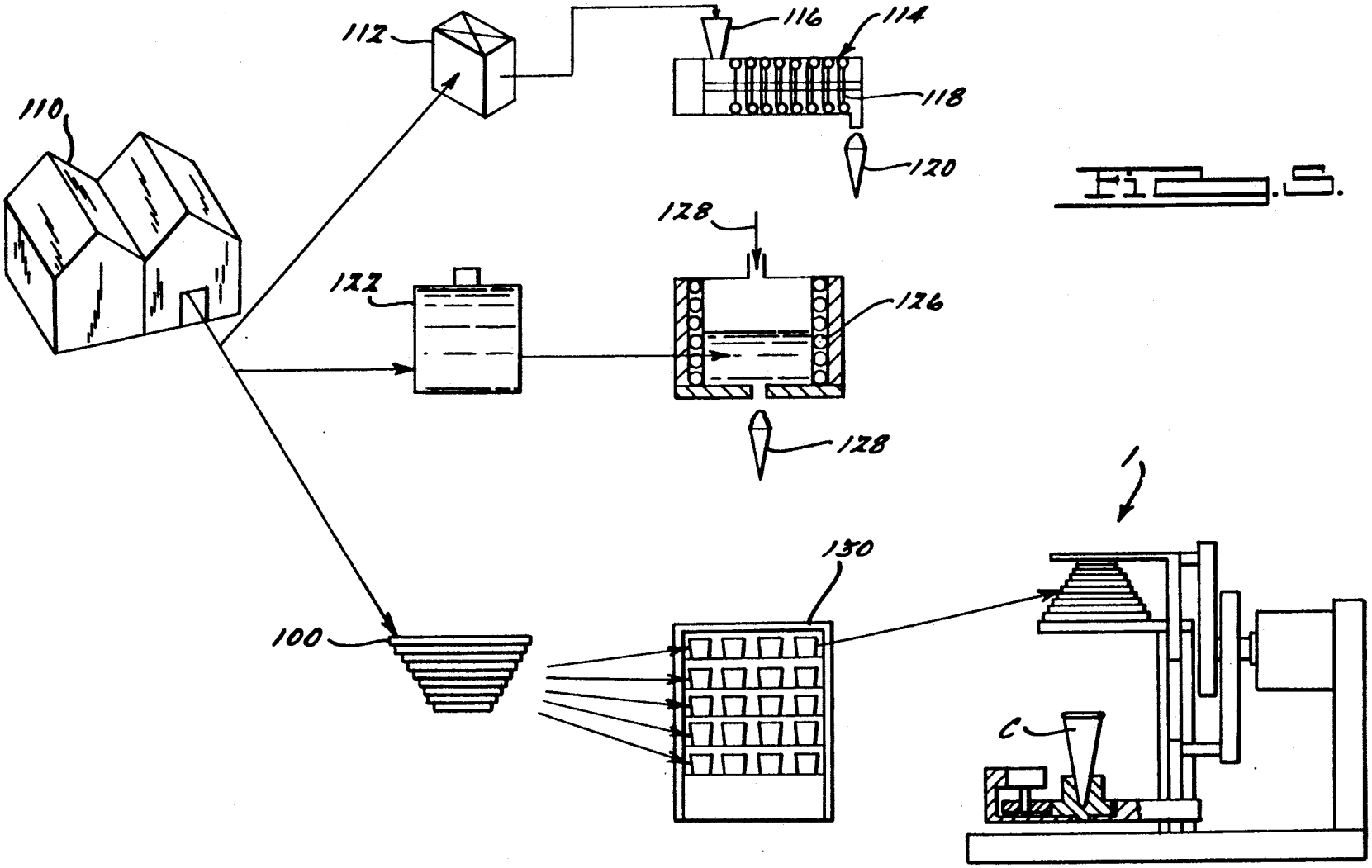
FIG. 5 is a diagram comparing three modes of packaging and delivery of soft ice cream.

Referring now to FIG. 5, there is shown a diagram comparing two prior modes of packaging and delivery of soft ice cream in accordance with the present invention. In the earlier mode, the soft ice cream or other frozen confection is produced in a factory 110. The soft ice cream fluid mix is packaged and shipped in a cardboard container 112 to a distributor or retail outlet. The distributor uses a soft ice cream freezer 114 containing a hopper 116 with vanes 118 to mix, freeze, aerate, and extrude the soft ice cream into an ice cream cone 120. In later systems, the soft ice cream is shipped in an extrudable bulky container 122 in the frozen state and is delivered to the distributor where an apparatus 124 utilizes a heat exchanger 126 and pressurized air 128 to extrude the soft ice cream into the cone cup 128. In accordance with the present invention, the soft ice cream in the factory 110 is packaged in the extrudable container 100 as discussed above, and delivered to the distributor where it is kept frozen in a freezer 130. It should be noted that numerous varieties of frozen ice cream may be kept in the extrudable containers 100 in a single freezer 130. Thus, the customer may order any of the numerous varieties. The extruding apparatus 1 may be utilized to extrude the soft ice cream into the cone cup as described above.

As explained above, the present invention provides a convenient press means for serving soft ice cream or the like which is being filled into a collapsible-type portion container in a frozen state into a cone cup, etc. Thus, it becomes possible to rapidly, economically, and sanitarily serve many varieties of soft ice cream or the like to many distributors. this feature is further amplified and enhanced by using a grooved cam or crank mechanism as the means for driving for the pusher, and moreover, by jointly using special support for a tableware which is eccentrically rotatable to the axis of the extrusion whereby precise control of serving patterns can be obtained.

Those skilled in the art can appreciate that other advantages can be obtained from the use of this invention and that modification may be made without departing from the true spirit of the invention after studying the specification, drawings and following claims.

What is claimed is:

1. An apparatus for serving a cold confection food from an extrudable package into a serving container, said apparatus comprising:

a horizontal table for supporting the extrudable package, said table having an opening therein;

a pusher positioned above said horizontal table;

a serving container support table positioned beneath the horizontal table; and means for moving the pusher so that it presses the extrudable package with relative approaching movement along a vertical direction and extrudes the cold confection food from the extrudable package through said opening into the serving container which is set on the serving container support table;

means for causing the serving container support table to descend gradually from the horizontal table along a vertical direction as the extruding operation progresses;

means for rotating the serving container; and cam means for carrying out the vertical movement of both the pusher and the serving container support table.

2. The apparatus of claim 1, wherein said extrudable package holds a single serving portion of said frozen confection.

3. The apparatus of claim 1, wherein the means for rotating rotates the serving container eccentrically with respect to an extruding center of axis of the extrudable package.

4. An apparatus for serving a cold confection food from an extrudable package into a serving container, said apparatus comprising:

a horizontal table for supporting the extrudable package, said table having an opening therein;

a pusher positioned above said horizontal table;

a serving container support table positioned beneath the horizontal table;

means for moving the pusher so that it presses the extrudable package with relative approaching movement along a vertical direction and extrudes the cold confection food from the extrudable package through said opening into the serving container which is set on the serving container support table; and means for forming a predetermined pattern in the confection food extending above a top surface of the serving container, which means for forming includes means for causing the serving container support table to descend gradually from the horizontal table along a vertical direction as the extruding operation progresses; and means for rotating the serving container;

wherein the bottom surface of the horizontal table and the top surface of the serving container are separated from each other vertically before the serving container descends during the extruding operation, and wherein the descent and rotation of the serving container produces said predetermined pattern in the confection food extending above the top surface of the serving container.

* * * * *

UNITED STATES PATENT AND TRADEMARK OFFICE

CERTIFICATE OF CORRECTION

PATENT NO. : 5,232,027

DATED : August 3, 1993

INVENTOR(S) : TANAKA et al

It is certified that error appears in the above-identified patent and that said Letters Patent is hereby corrected as shown below:

On the cover page, please add item [30], Foreign Application Priority Data, --Japanese Patent No. 2-104857, October 3, 1990.--

Signed and Sealed this

Fifteenth Day of March, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,232,027

DATED : August 3, 1993

INVENTOR(S) : Tanaka et al.

It is certified that error appears in the above-identified patent and that said Letters Patent is hereby corrected as shown below:

Column 4, line 36, change "D" to --d--.

line 52, change "this" to --This--.

Signed and Sealed this

Ninth Day of August, 1994

Bruce Lehman

*Attest:*

BRUCE LEHMAN

*Attesting Officer*

*Commissioner of Patents and Trademarks*